US008080157B2

(12) United States Patent
Fenton

(10) Patent No.: US 8,080,157 B2
(45) Date of Patent: Dec. 20, 2011

(54) DOWNHOLE GRAVITATIONAL WATER SEPARATOR

(75) Inventor: Stephen P. Fenton, Balmedie (GB)

(73) Assignee: Vetco Gray Inc., Houston, TX (US)

( * ) Notice: Subject to any disclaimer, the term of this patent is extended or adjusted under 35 U.S.C. 154(b) by 136 days.

(21) Appl. No.: 12/428,923

(22) Filed: Apr. 23, 2009

(65) Prior Publication Data

US 2009/0266755 A1 Oct. 29, 2009

Related U.S. Application Data

(60) Provisional application No. 61/047,243, filed on Apr. 23, 2008.

(51) Int. Cl.
*B01D 17/02* (2006.01)

(52) U.S. Cl. ..... 210/170.01; 210/522; 210/540; 166/357; 166/265

(58) Field of Classification Search ..... 210/170.01, 210/170.07, 521, 522, 532.1, 540; 166/265, 166/357

See application file for complete search history.

(56) References Cited

U.S. PATENT DOCUMENTS

| | | | | |
|---|---|---|---|---|
| 2,838,178 | A * | 6/1958 | Bankes | 210/170.01 |
| 3,893,918 | A * | 7/1975 | Favret, Jr. | 210/170.01 |
| 4,241,787 | A | 12/1980 | Price | |
| 4,424,068 | A | 1/1984 | McMillan | |
| 4,720,341 | A * | 1/1988 | Arnold | 210/522 |
| 4,816,146 | A | 3/1989 | Schertler | |
| 5,443,120 | A * | 8/1995 | Howell | 166/265 |
| 5,693,225 | A * | 12/1997 | Lee | 166/265 |
| 6,033,567 | A | 3/2000 | Lee et al. | |
| 6,367,547 | B1 | 4/2002 | Towers et al. | |
| 6,547,005 | B2 * | 4/2003 | Haheim | 166/265 |
| 6,550,535 | B1 | 4/2003 | Traylor | |
| 6,755,978 | B2 * | 6/2004 | Oddie | 210/170.01 |
| 6,845,821 | B2 * | 1/2005 | Bouma et al. | 210/170.01 |
| 7,175,748 | B2 | 2/2007 | Michaelsen et al. | |
| 7,240,736 | B2 | 7/2007 | Fenton et al. | |
| 7,255,167 | B2 * | 8/2007 | Cognata | 166/265 |
| 7,314,559 | B2 | 1/2008 | Hopper | |
| 7,516,794 | B2 | 4/2009 | Gramme et al. | |
| 2004/0060705 | A1 | 4/2004 | Kelley | |
| 2006/0027362 | A1 * | 2/2006 | Cognata | 166/265 |

FOREIGN PATENT DOCUMENTS

| | | |
|---|---|---|
| EP | 0964134 A2 | 3/2000 |
| GB | 2435436 A | 8/2007 |
| WO | WO 99/15755 | 4/1999 |
| WO | WO 99/25480 | 5/1999 |
| WO | WO2007/096316 A1 | 8/2007 |

OTHER PUBLICATIONS

John A. Veil, Interest revives in downhole oil-water separators, Oil and Gas Journal, Feb. 16, 2001, vol. 99, issue 9.

* cited by examiner

*Primary Examiner* — Christopher Upton
(74) *Attorney, Agent, or Firm* — Bracewell & Giuliani LLP

(57) ABSTRACT

A gravity water separation system that may be integrated within a well completion. A diverted flowpath is provided for produced hydrocarbons, external to the completion tubing. As produced hydrocarbons travel through the diverted flowpath, they pass through separation stages wherein gravity separation ensues by migration through predefined flow ports which extend from produced oil "separation chamber(s)" into separated "water chamber(s)."

18 Claims, 5 Drawing Sheets

DOWNHOLE GRAVITATIONAL WATER SEPARATOR

CROSS-REFERENCE TO RELATED APPLICATIONS

This application claims priority to provisional application 61/047,243, filed Apr. 23, 2008.

FIELD OF THE INVENTION

This disclosure relates to a water separator, and in particular, to a downhole gravitational water separator for subsea well operations.

BACKGROUND OF THE INVENTION

Growing emphasis on increasing the reservoir recovery factor for subsea well operations provides a stimulus for separation of water from produced hydrocarbons. Additionally, onshore wells very often have to cope with significant water breakthrough (70-80%+ of water in oil (WiO)). Fundamentally, water separation provides significant operational efficiency gains.

Water separation provides for reduction of back pressure on the reservoir by reduction of static hydraulic head (i.e., lower specific gravity of produced fluid in the pipeline, which can be significant in deeper waters and deeper reservoirs) and reduced frictional effects in the subsea pipeline. It may operate at a lower relative flowrate than for the combined oil+ effluent volume. The reduction of back pressure on the reservoir and the reduced frictional effects in the subsea pipeline provide an opportunity for increasing total reservoir recovery over field life, by reducing field abandonment pressure, and/or deferring the time at which pressure boosting might be considered necessary, where feasible.

Water separation allows for the reduction in size of export flowline(s) for a given scenario. Reduction in size of export flowline(s) can significantly reduce the total installed cost of the pipeline, particularly on subsea developments where pipeline costs are always a predominant cost factor. Water separation also reduces dependence on chemical injection, which is otherwise required for hydrate mitigation. By eliminating dependence on chemical injection, consumables cost over field life may be reduced.

A need exists for a technique that addresses the emphasis on increasing the reservoir recovery factor for subsea well operations by separation of water from produced hydrocarbons. A new technique in necessary to simplify total system installation and to provide available separation capacity at the earliest point in field life without disruption to production. The following technique may solve one or more of these problems.

SUMMARY OF THE INVENTION

A gravity water separation system that may be integrated within a well completion. A diverted flowpath is provided for produced hydrocarbons, external to the completion tubing. As produced hydrocarbons travel through the diverted flowpath, they pass through separation stages wherein gravity separation ensues by migration through predefined flow ports which extend from produced oil "separation chamber(s)" into separated "water chamber(s)."

An operable full bore isolation valve is provided, maintaining access to the wellbore for through-tubing operations over field life, while also providing the means for flow diversion under a "separation enabled" mode. The full bore isolation valve also provides a "separator by-pass" mode for early field production (i.e., prior to water cut) and over field life in the case of flow disruption through the separator for whatever reason.

DETAILED DESCRIPTION OF THE INVENTION

Figure 1:
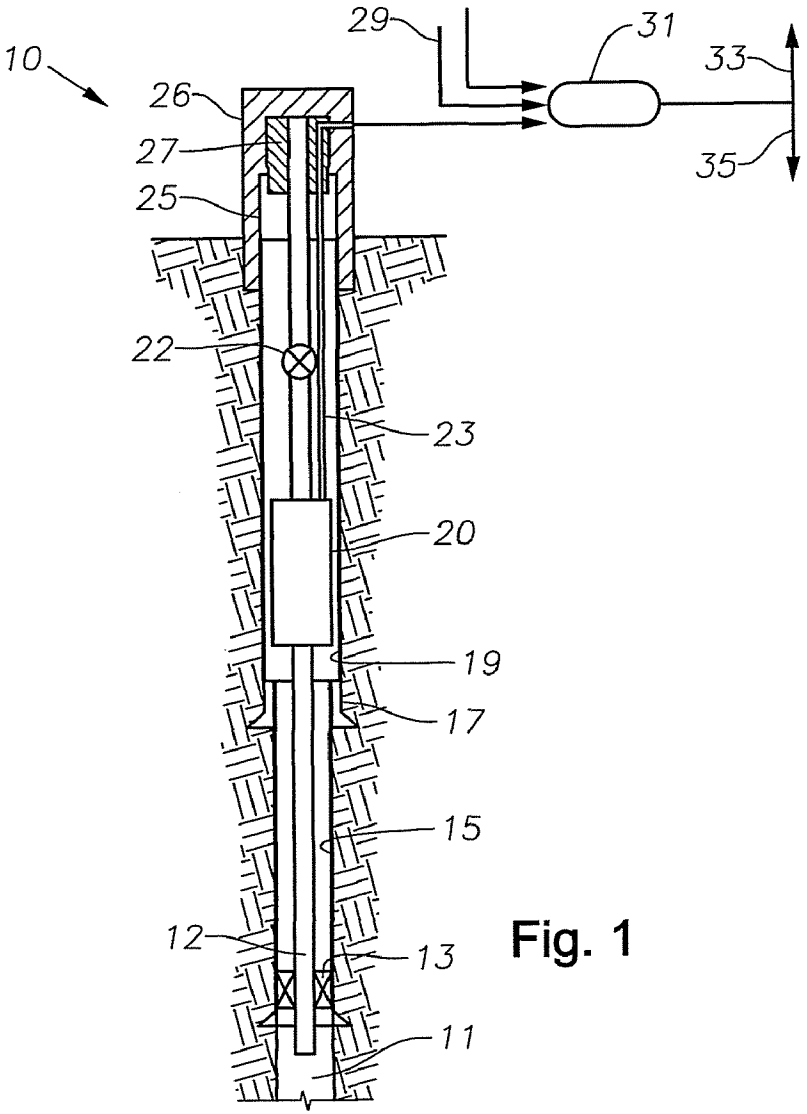
FIG. 1 is a schematic view of a wellbore with a downhole water separation unit installed.

Referring to FIG. 1, an exemplary embodiment of a wellbore completion assembly, represented by reference numeral 10, is shown in side view and includes production tubing 12, which extends into a formation 11. Production tubing 12 runs from tubing hanger 27 in the wellhead 26 down into fluid communication with a producing formation. Production casing or liner 15 extends downward from a liner hanger 17, or otherwise from a casing hanger of suitable size in the wellhead. Production packer 13 isolates an annulus between the production tubing 12 and the production casing 15.

Water separation unit 20 is installed within surface casing 19 downhole, and is connected to production tubing 12. Surface casing 19 extends downward from casing hanger 25. A surface controlled, subsurface safety valve (SCSSSV) 22 is located on the production tubing 12, above the water separation unit 20. SCSSSV 22 is a downhole safety valve that is operated from surface facilities through a control line strapped to the external surface of the production tubing 12. The control system operates in a fail-safe mode, with hydraulic control pressure used to hold open a ball or flapper assembly that will close if the control pressure is lost. This means that when closed, SCSSSV 22 will isolate the reservoir fluids from the surface.

Figure 2:
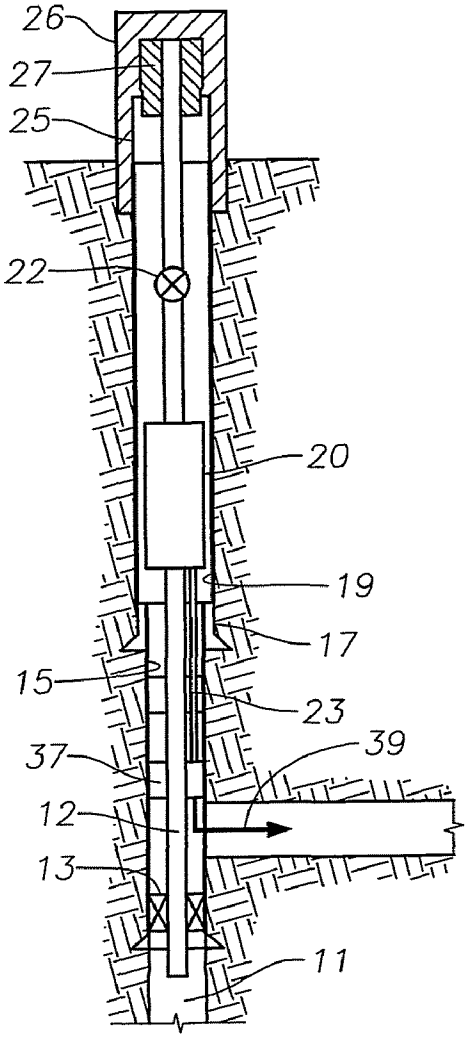
FIG. 2 is a schematic view of a wellbore with a downhole water separation unit and water pump installed.

In FIGS. 1 and 2, flow from the formation 11 travels up the production tubing 12 and enters the separation unit 20. Once the flow reaches separation unit 20, a separation device removes water (i.e., the more dense fluid) from the oil and water mixture (i.e., production fluid) as it flows through the unit 20. Once the desired amount of separation has occurred, the flow (i.e., less dense fluid) reenters the production tubing 12 and is directed to the surface. The water (i.e., more dense fluid) that was removed from the flow (i.e., production fluid) in the separation unit 20 can be further processed or re-injected.

In FIG. 1, the water removed from the flow in the separation unit 20 travels through water disposal line 23, and then into an external separation device 31. External separation device 31 may also receive water from other sources 29, before further separating the water, and dispersing it to the sea through a sea exit line 33, or re-injecting it through a re-injection line 35. As FIG. 2 illustrates, in an alternate embodiment, the water removed from the flow in the separation unit 20 travels through water disposal line 23, is pumped through a downhole water pump 37, and re-injected to an injection zone through re-injection line 39.

Figure 3:
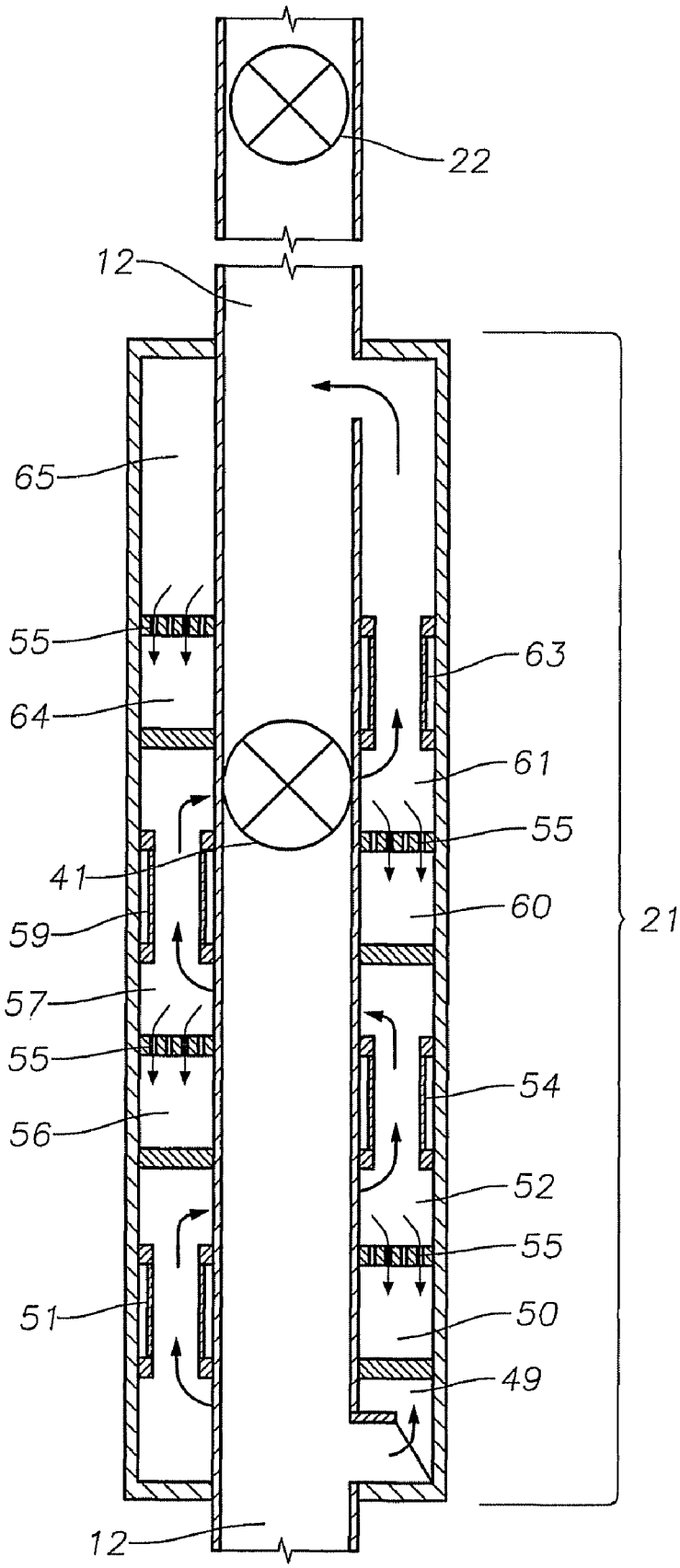
FIG. 3 is a vertical cross sectional view of a downhole gravitational water separation unit with labyrinth chambers.

FIG. 3 illustrates a separation unit 21 comprised of a gravitational water separator with labyrinth chambers radially circumscribing a length of production tubing 12. An operable full bore isolation valve (FBIV) 41 is located in the production tubing 12 within the separation unit 21. FBIV 41 allows access to be maintained to the wellbore for through tubing operations over field life, while providing the means for flow diversion through the separator 21 under "Separation Enabled" mode. The FBIV 41 additionally provides a "Separator By-Pass" mode for early field production (i.e. prior to water cut) and over field life in case of flow disruption through the separator 21. FBIV 41 may be replaced by an alternative closure mechanism such as a remotely installed plug.

Figure 4:
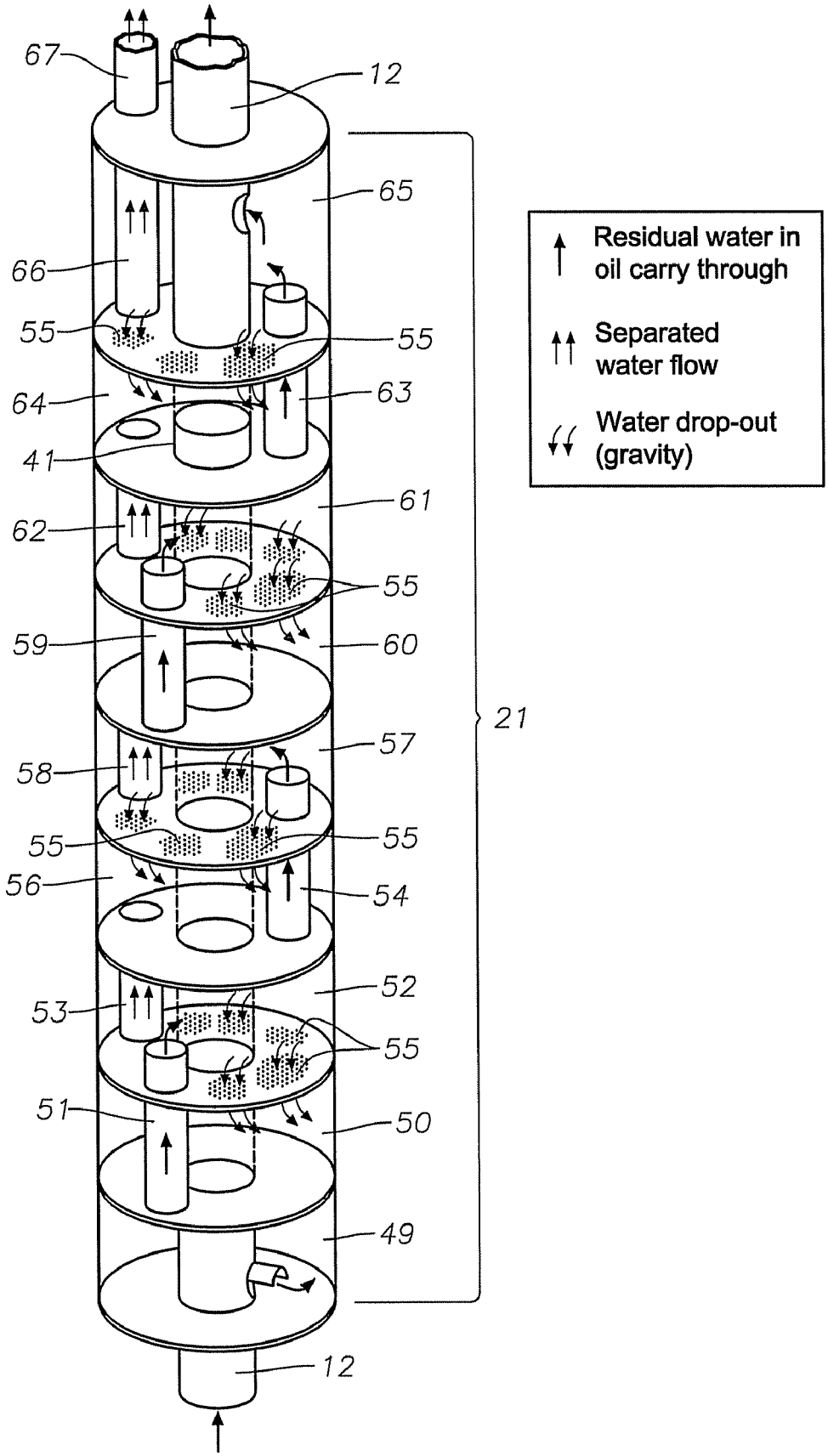
FIG. 4 is an isometric view of a downhole gravitational water separation unit with labyrinth chambers.

Referring to FIGS. 3 and 4, when FBIV 41 is closed and in "Separation Enabled" mode, flow (i.e., production fluid) from the formation travels up the production tubing 12, where it is blocked by the closed FBIV 41, thus forcing the flow to enter the separation unit 21. The flow then enters initial flow chamber 49 and travels upwards through oil flow tube 51, which carries the oil and water mixture through water chamber 50. It is important to note that the flow is completely isolated from water chamber 50 by flow tube 51. Flow tube 51 terminates in a separation chamber 52. The separation chamber 52 comprises a plurality of small holes 55 on its lower surface. As the flow passes over holes 55, the gravitational forces exerted on the fluid mixture causes water (i.e., more dense fluid) within the flow to drop out and to travel through holes 55 and into water chamber 50 below. After flowing over the holes 55, the mixture (i.e., less dense fluid) continues upward through flow tube 54. Flow tube 54 then passes through water chamber 56 before opening to separation chamber 57.

When the flow reaches separation chamber 57, the oil and water mixture again passes over a grate-like floor that has a number of small holes 55 on its surface. As the flow passes over holes 55, the gravitational forces exerted on the fluid mixture causes water within the flow to drop out and to travel through holes 55 and into water chamber 56 below. Once the flow has passed over the holes 55, it continues upward through flow tube 59. Flow tube 59 then passes through water chamber 60 before opening to separation chamber 61. When the flow reaches separation chamber 61, the oil and water mixture again passes over a grate-like floor that has a number of small holes 55 on its surface. As the flow passes over holes 55, the gravitational forces exerted on the fluid mixture causes water within the flow to drop out and to travel through holes 55 and into water chamber 60 below. Once the flow has passed over the holes 55, it continues upward through flow tube 63. Flow tube 63 then passes through water chamber 64 before opening to the final separation chamber 65.

Figure 5:
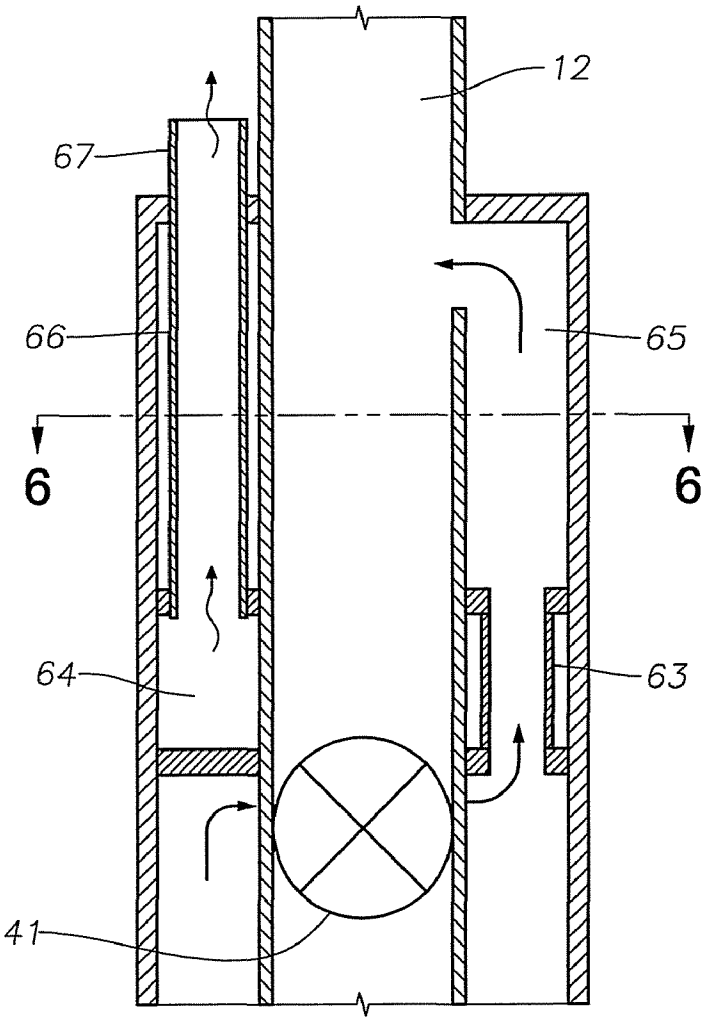
FIG. 5 is a vertical cross sectional view of the final chamber in a gravitational water separation unit with labyrinth chambers.

Referring to FIGS. 4 and 5, when the flow reaches the final separation chamber 65, the oil and water mixture again passes over a grate-like floor that has a number of small holes 55 on its surface. As the flow passes over holes 55, the gravitational forces exerted on the fluid mixture causes water within the flow to drop out and to travel through holes 55 and into water chamber 64 below. Once the oil flow (i.e., less dense fluid) has passed over the holes 55, it reenters the production tubing 12 above the FBIV 41, and is directed to the surface.

Referring to FIG. 4, water chambers 50, 56, 60, 64 in the separation unit 21 are connected to one another by water flow tubes 53, 58, 62. The water that enters water chamber 50 travels through water flow tube 53 which is connected to water chamber 56. The water that enters water chamber 56 travels through water flow tube 58 which is connected to water chamber 60. The water that enters water chamber 60 travels through water flow tube 62 which is connected to water chamber 64. As previously illustrated in FIGS. 1 and 2, the water disposal line can flow upwards or downwards from the separation unit, and may be attached to a water pump or an additional separation unit before being disposed of or re-injected into the aquifer. For example, in FIGS. 4 and 5 the water that enters water chamber 64 travels through outgoing water flow tube 66, and then travels from separation unit 21 through water disposal line 67.

Figure 6:
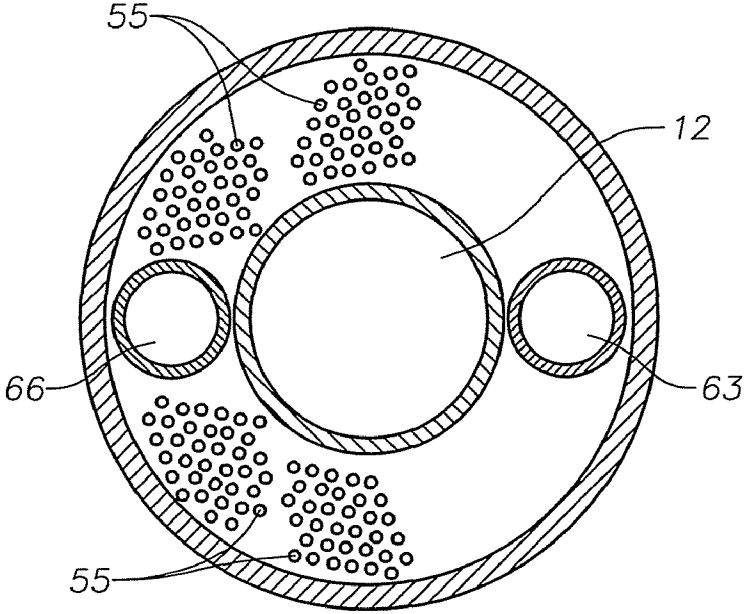
FIG. 6 is a lateral cross sectional view of the separation chamber of FIG. 5.

FIG. 6 illustrates a cross sectional view of FIG. 5 along line 6-6. Fluid flows into the final separation chamber 65 through flow tube 63, and passes over holes 55. Water from the water chambers flows upward and out of the separation unit 21 through outgoing water line 66. The remaining oil and water mixture reenters production tubing 12, and continues on.

Although this embodiment of a separation unit contains four separation "stages," the number of separation "stages," including accompanying water chambers, depends on the desired oil to water ratio of the flow leaving the separation unit. The length of the separation unit is also dictated by the number of separation "stages" desired.

Figure 7:
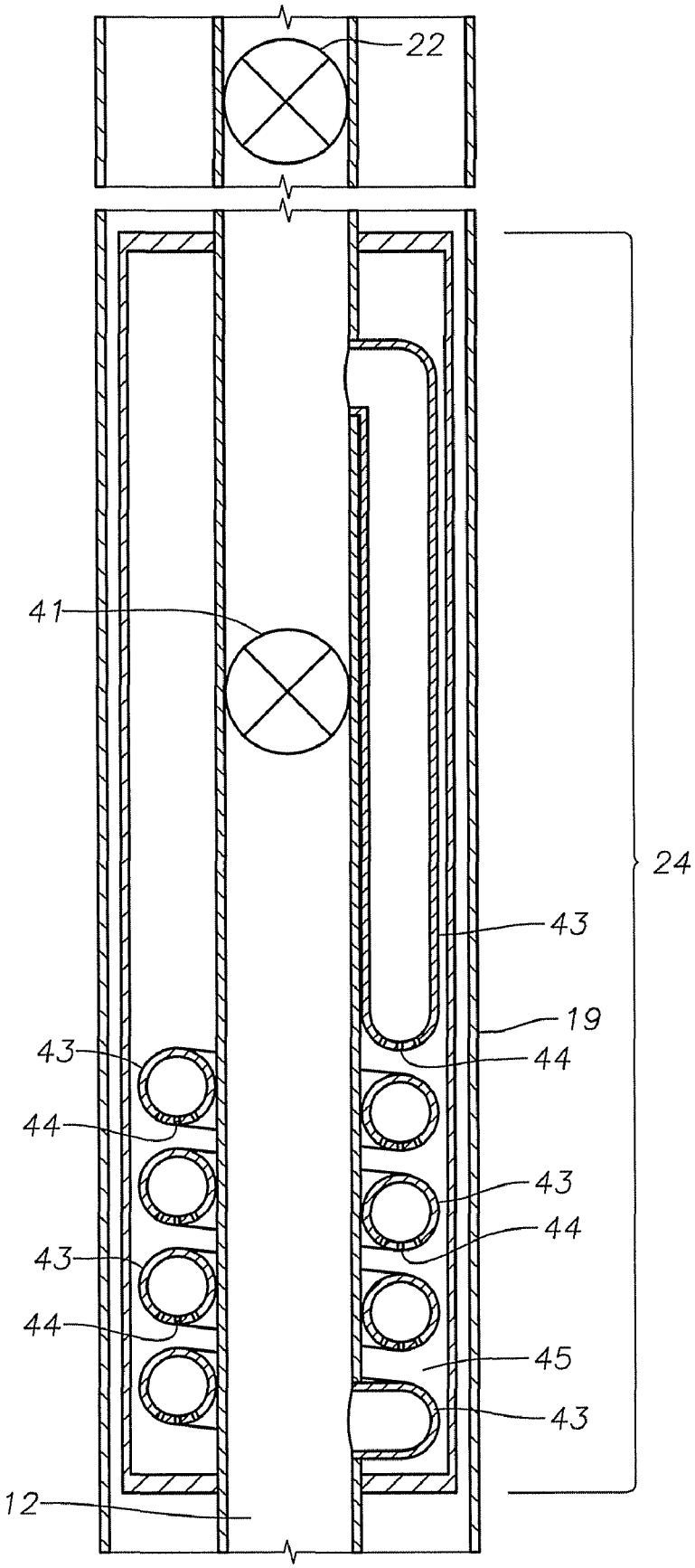
FIG. 7 is a vertical cross sectional view of a downhole helical water separation unit.

FIG. 7 illustrates an alternate embodiment separation unit 24. In this embodiment, flow from production line 12 enters a helical flow tube 43, which wraps upwards and around production tubing 12. An operable full bore isolation valve (FBIV) 41 is located in the production tubing 12 within the separation unit 24. The FBIV 41 operates as previously discussed, to selectively direct the flow to pass through the separation unit 24. As the water and oil mixture enters the helical tube 43, the flow travels over holes 44 in the bottom of the tube 43. As the flow passes over holes 44, the gravitational forces exerted on the fluid mixture causes water within the flow to drop out and to travel through holes 44 and into water chamber 45 below. The water chamber 45 is comprised of the annulus between the production line 12 and the surface casing 19. The flow continues upward through the helical tubing 43, until it reconnects with production line 12. As previously discussed, the water captured in water chamber 45 can be removed from the separation unit 24 by a number of different methods. The length of helical tubing 43 and separation unit 24, depends on the desired oil to water ratio of the fluid leaving the separation unit 24.

The gravitational water separator system as comprised by the technique has significant advantages. The gravitational water separator system may be integrated within the well completion, simplifying total system installation (i.e., no separate structure needed as required for a seabed installed system, with attendant installation costs, and reduced topsides costs), and providing available separation capacity at the earliest point in field life without disruption to production.

While the technique has been described in only one of its forms, it should be apparent to those skilled in the art that it is not so limited, but is susceptible to various changes without departing from the scope of the technique.

The invention claimed is

1. A water separation system for use in well operations, the water separator comprising:

a hollow cylindrical body having a longitudinal axis;

a conduit extending coaxially through the body and having a valve positioned therein to open and close a portion of the conduit and a threaded upper end for securing it to a lower end of a string of production tubing, the lower end of the conduit being open to admit production fluid;

a gravity separation device mounted in the body around the conduit;

a lower port in the conduit, below the valve, leading to the gravity separation device for admitting production fluid when the valve is closed; and an upper port in the conduit, above the valve, leading from the gravity separation device back into the conduit.

2. The water separator of claim 1, wherein the gravity separation device further comprises:

a partition containing a plurality of apertures and the partition defining a less dense fluid passage above the partition and a more dense fluid passage below the partition;

a more dense fluid discharge port extending through the body from the more dense fluid passage for discharging more dense fluid; and wherein the lower port leads to the less dense fluid passage and the upper port leads from the less dense fluid passage.

3. The water separator of claim 1, wherein the gravity separation device further comprises a helical tube extending axially along the length of the longitudinal axis such that the helical tube surrounds and wraps around the conduit, the tube having apertures located in and extending through a lower surface thereof.

4. The water separator of claim 3, wherein the annular area between the inner peripheries of the gravity separation device and the outer peripheries of the conduit define a more dense fluid chamber to allow for gravity to force more dense fluid contained in the production fluid to travel through the apertures in the tubing and into the more dense fluid chamber positioned below.

5. The water separator of claim 1, wherein the gravity separation device further comprises at least one separation stage, each separation stage comprised of a separation chamber axially aligned with and stacked atop a water chamber along the length of the axis.

6. The water separator of claim 5, wherein the separation chamber is defined as the interstitial space between an upper wall, a lower wall, and the sidewall extending therebetween, and wherein the lower wall has a number of apertures located in and extending therethrough to allow for gravity to force more dense fluid contained in the production fluid to travel from the separation chamber through the apertures and into the water chamber positioned below.

7. The water separator of claim 6, further comprising a more dense fluid discharge port extending through the body from the water chamber for discharging more dense fluid.

8. The water separator of claim 6, further comprising:

a more dense fluid flow pipe extending between and connecting each water chamber; and a less dense fluid flow pipe extending between and connecting each separation chamber.

9. A water separation system for use in well operations, the water separator comprising:

a hollow cylindrical body having a longitudinal axis;

a conduit extending coaxially through the body and having a valve positioned therein to open and close a portion of the conduit and a threaded upper end for securing it to a lower end of a string of production tubing, the lower end of the conduit being open to admit production fluid;

a gravity separation device mounted in the body around the conduit, the gravity separation device comprising a plurality of separation stages, each separation stage comprising a separation chamber axially aligned with and stacked atop a water chamber along the length of the axis;

a more dense fluid flow pipe extending between and connecting each water chamber;

a less dense fluid flow pipe extending between and connecting each separation chamber;

a lower port in the conduit, below the valve, leading to the gravity separation device for admitting production fluid when the valve is closed; and an upper port in the conduit, above the valve, leading from the gravity separation device back into the conduit.

10. The water separator of claim 9, wherein each separation chamber is defined as the interstitial space between an upper wall, a lower wall, and the sidewall extending therebetween, and wherein the lower wall has a number of apertures located in and extending therethrough to allow for gravity to force more dense fluid contained in the production fluid to travel from the separation chamber through the apertures and into the water chamber positioned below.

11. The water separator of claim 9, further comprising a more dense fluid discharge port extending through the body from at least one of the water chambers for discharging more dense fluid.

12. A water separation system for use in well operations, the water separator comprising:

a hollow cylindrical body having a longitudinal axis;

a conduit extending coaxially through the body and having a valve positioned therein to open and close a portion of the conduit and a threaded upper end for securing it to a lower end of a string of production tubing, the lower end of the conduit being open to admit production fluid;

a gravity separation device comprising a helical tube extending axially along the length of the longitudinal axis such that the helical tube surrounds and wraps around the conduit, the tube having apertures located in and extending through a lower surface thereof;

a lower port in the conduit, below the valve, leading to the gravity separation device for admitting production fluid when the valve is closed; and an upper port in the conduit, above the valve, leading from the gravity separation device back into the conduit.

13. The water separator of claim 12, wherein the annular area between the inner peripheries of the gravity separation device and the outer peripheries of the conduit define a more dense fluid chamber to allow for gravity to force more dense fluid contained in the production fluid to travel through the apertures in the tubing and into the more dense fluid chamber positioned below.

14. The water separator of claim 13, further comprising a more dense fluid discharge port extending through the body from the water chamber for discharging more dense fluid.

15. A wellbore system, comprising:

a fluid separator adapted to be disposed downhole within a wellbore, the fluid separator comprising at least two gravity separation stages, wherein each gravity separation stage comprises:

a first chamber adapted to receive a mixture of a first fluid having a first density and a second fluid having a second density greater than the first density and to enable at least a portion of the first fluid to separate from the second fluid due to gravity and float atop the second fluid, wherein the first chamber is adapted with a first opening on a lower portion of the first chamber; and a second chamber disposed below the first chamber, wherein the second chamber is adapted to receive fluid from the first chamber via the first opening; and wherein the fluid separator is adapted to communicate fluid floating atop the second fluid to a first chamber of a second gravity separation stage disposed above the first gravity separation stage.

16. The wellbore system as recited in claim 15, wherein the fluid separator comprises a plurality of gravity separation stages, each gravity separation stage removing a portion of the second fluid from an initial mixture of second fluid and first fluid.

17. The wellbore system as recited in claim 15, wherein the first opening comprises a plurality of openings in a floor of the first chamber.

18. A wellbore system, comprising:

a fluid separator adapted to be disposed downhole within a wellbore, the fluid separator comprising at least two gravity separation stages, wherein each gravity separation stage comprises:

a first chamber adapted to receive a mixture of a first fluid having a first density and a second fluid having a second density greater than the first density and to enable at least a portion of the first fluid to separate from the second fluid due to gravity and float atop the second fluid., wherein the first chamber is adapted with a first opening on a lower portion of the first chamber; and a second chamber disposed below the first chamber, wherein the second chamber is adapted to receive fluid from the first chamber via the first opening; and wherein the fluid separator is adapted to communicate fluid in the second chamber to a second chamber of a second gravity separation stage disposed above the gravity separation stage.

* * * * *